US007581824B2

(12) United States Patent
Fujii et al.

(10) Patent No.: US 7,581,824 B2
(45) Date of Patent: Sep. 1, 2009

(54) ELECTROSTATIC ACTUATOR, DROPLET DISCHARGE HEAD AND METHOD FOR MANUFACTURING THE DROPLET DISCHARGE HEAD, DROPLET DISCHARGE APPARATUS, AND DEVICE

(75) Inventors: Masahiro Fujii, Shiojiri (JP); Katsuji Arakawa, Chino (JP)

(73) Assignee: Seiko Epson Corporation (JP)

( * ) Notice: Subject to any disclaimer, the term of this patent is extended or adjusted under 35 U.S.C. 154(b) by 464 days.

(21) Appl. No.: 11/295,818

(22) Filed: Dec. 7, 2005

(65) Prior Publication Data

US 2006/0125879 A1 Jun. 15, 2006

(30) Foreign Application Priority Data

Dec. 14, 2004 (JP) ..... 2004-361001
Feb. 28, 2005 (JP) ..... 2005-052596
Sep. 21, 2005 (JP) ..... 2005-273797

(51) Int. Cl.
*B41J 2/045* (2006.01)

(52) U.S. Cl. ..... 347/71; 347/70; 347/68; 347/54; 347/55; 347/64

(58) Field of Classification Search ..... 347/54–55, 347/63–64, 70–72
See application file for complete search history.

(56) References Cited

U.S. PATENT DOCUMENTS 5,513,431 A 5/1996 Ohno et al.
5,534,900 A 7/1996 Ohno et al.
5,912,684 A 6/1999 Fujii et al.
6,113,218 A 9/2000 Atobe et al.
6,117,698 A 9/2000 Atobe et al.
6,120,124 A 9/2000 Atobe et al.
6,164,759 A 12/2000 Fujii et al.
6,168,263 B1 1/2001 Nojima et al.
6,341,850 B1 1/2002 Sakai
6,367,914 B1 * 4/2002 Ohtaka et al. ..... 347/54
6,660,567 B2 12/2003 Choo et al.
6,730,594 B2 * 5/2004 Noguchi et al. ..... 438/653
6,909,133 B2 6/2005 Furukawa et al.
7,211,497 B2 5/2007 Hiraiwa et al.
7,217,607 B2 5/2007 Furukawa et al.

(Continued)

FOREIGN PATENT DOCUMENTS

JP 6-71882 3/1994

(Continued)

*Primary Examiner*—Matthew Luu
*Assistant Examiner*—Henok Legesse
(74) *Attorney, Agent, or Firm*—Harness, Dickey & Pierce, P.L.C.

(57) ABSTRACT

To provide an electrostatic actuator that generates high pressure under a given voltage and includes an insulating film exhibiting excellent insulation resistance, a droplet discharge head that includes the electrostatic actuator and a method for manufacturing the droplet discharge head, a droplet discharge apparatus that includes the droplet discharge head and has excellent printing performance, and a device that includes the electrostatic actuator and has excellent driving performance. A diaphragm 12, a counter electrode 17 opposite to the diaphragm 12 with a gap interposed therebetween, and an insulating film 16 on a surface of the diaphragm 12 opposite to the counter electrode 17 are included. The insulating film 16 includes at least a dielectric film 16*a* formed of a substance having a higher relative dielectric constant than silicon oxide.

17 Claims, 8 Drawing Sheets

U.S. PATENT DOCUMENTS

| | | | |
|---|---|---|---|
| 2007/0187764 | A1 | 8/2007 | Furukawa et al. |
| 2007/0190744 | A1 | 8/2007 | Hiraiwa et al. |

FOREIGN PATENT DOCUMENTS

| | | | |
|---|---|---|---|
| JP | 07-214769 | | 8/1995 |
| JP | 10-086361 | | 4/1998 |
| JP | 11-165413 | | 6/1999 |
| JP | 11-348277 | | 12/1999 |
| JP | 2000-052548 | | 2/2000 |
| JP | 2000-127393 | | 5/2000 |
| JP | 2000-318155 | | 11/2000 |
| JP | 2001077505 | * | 9/2001 |
| JP | 2001-277505 | | 10/2001 |
| JP | 2002-046282 | | 2/2002 |
| JP | 2002-172777 | | 6/2002 |
| JP | 2002-321357 | | 11/2002 |
| JP | 2002-337337 | | 11/2002 |
| JP | 2003-142579 | | 5/2003 |
| JP | 2003-152102 | | 5/2003 |
| JP | 2004-066571 | | 3/2004 |
| JP | 2004-153037 | | 5/2004 |
| JP | 2004-284098 | | 10/2004 |
| WO | WO98/18632 | | 5/1998 |

* cited by examiner (f)

(g)

(h)

(i)

ELECTROSTATIC ACTUATOR, DROPLET DISCHARGE HEAD AND METHOD FOR MANUFACTURING THE DROPLET DISCHARGE HEAD, DROPLET DISCHARGE APPARATUS, AND DEVICE

The entire disclosure of Japanese Patent Application No. 2004-361001 filed Dec. 14, 2004, Japanese Patent Application No. 2005-052596 filed Feb. 28, 2005, Japanese Patent Application No. 2005-273797 filed Sep. 21, 2005, are expressly incorporated by references herein.

TECHNICAL FIELD

The present invention relates to an electrostatic actuator, a droplet discharge head and a method for manufacturing the droplet discharge head, a droplet discharge apparatus, and a device, and more specifically, it relates to an electrostatic actuator that generates high pressure and has reliable insulation characteristics, a droplet discharge head including the electrostatic actuator and a method for manufacturing the droplet discharge head, a droplet discharge apparatus including the droplet discharge head, and a device including the electrostatic actuator.

BACKGROUND ART

An ink-jet printer has many advantages, such as high-speed printing capability, very low noise during printing, flexibility of ink, and availability of inexpensive plain paper. In recent years, an ink-on-demand ink-jet printer, which discharges ink droplets only when printing is required, is the mainstream among ink-jet printers. This ink-on-demand ink-jet printer has advantages, for example, in that it eliminates the need for collecting unused ink droplets.

The ink-on-demand ink-jet printer includes an electrostatic driving ink-jet printer, which utilizes electrostatic force as driving means in the method for discharging ink droplets, a piezoelectric driving ink-jet printer, which utilizes a piezoelectric element as driving means, and a Bubble Jet® ink-jet printer, which utilizes a heating element.

In the electrostatic driving ink-jet printer, a diaphragm and an individual electrode disposed opposite to the diaphragm are electrically charged and thereby the diaphragm is attracted and bends toward the individual electrode. Such a mechanism by which two substances are electrically charged for driving in a small apparatus is generally referred to as an electrostatic actuator. In an apparatus using an electrostatic actuator, such as an ink-jet printer, an insulating film for preventing dielectric breakdown and short is generally formed between two electrically charged substances (a diaphragm and a individual electrode).

In a conventional electrostatic actuator and a method for manufacturing the conventional electrostatic actuator, an individual electrode for driving a diaphragm is formed in a staircase pattern, and an insulating film for preventing dielectric breakdown and short is formed on the individual electrode. Silicon oxide or silicon nitride is used as a material for the insulating film (see, for example, Patent Document 1).

Furthermore, in a method for manufacturing a conventional semiconductor device, a gate insulating film of a field-effect transistor is also formed of silicon oxynitride, as well as silicon oxide or silicon nitride, formed by plasma chemical vapor deposition (CVD) (see, for example, Patent Documents 2 and 3).

[Patent Document 1] JP-A-1-2000-318155 (p. 2, FIG. 2).
[Patent Document 2] JP-A-1-2004-153037 (p. 2).
[Patent Document 3] JP-A-1-2003-142579 (p. 2).

SUMMARY

In the conventional electrostatic actuator and the method for manufacturing the conventional electrostatic actuator (see, for example, Patent Document 1), silicon oxide or silicon nitride is used as a material for the insulating film. When silicon oxide is used as a material for the insulating film, although there are variations depending on the manufacturing method, the generated pressure and the insulation resistance are almost constant under a given voltage. Thus, the pressure and the insulation resistance cannot be further improved.

In a method for manufacturing a conventional semiconductor device (see, for example, Patent Documents 2 and 3), silicon oxynitride is used as a material for a gate oxide film. However, direct application of this to an insulating film of the electrostatic actuator can hardly satisfy both the increase in the generated pressure and the increase in the insulation resistance.

Accordingly, the object of the present invention is to provide an electrostatic actuator that generates high pressure under a given voltage and includes an insulating film exhibiting excellent insulation resistance, a droplet discharge head that includes the electrostatic actuator and a method for manufacturing the droplet discharge head, a droplet discharge apparatus that includes the droplet discharge head and has excellent printing performance, and a device that includes the electrostatic actuator and has excellent driving performance.

Furthermore, one conventional problem is that when a diaphragm is doped with an impurity, such as boron, to ensure the precision in thickness during the formation of the diaphragm, the diffusion of the impurity, such as boron, into an insulating film may decrease the withstand voltage of the insulating film, causing the insulating film to break down and impairing driving durability. Another conventional problem is that the effects of the residual electric charge on the surface of an insulating film destabilize the electrostatic attraction, interfering with the stable driving of an actuator. Still other conventional problems are that a simple increase in the thickness of an insulating film reduces the electrostatic attraction and thus results in a larger actuator and that when a substrate including a diaphragm is anodically bonded to a substrate including a counter electrode, the bonding strength decreases or a poor bonding occurs.

The present invention has been achieved to address the problems described above. The present invention proposes a small electrostatic actuator with high driving durability in which an adequate withstand voltage between a diaphragm and a counter electrode is maintained for a long period of time and the driving voltage of the actuator is reduced. The present invention also proposes an electrostatic actuator that has reduced effects of the residual electric charge between a diaphragm and a counter electrode and thereby can be driven stably. The present invention further proposes a droplet discharge head including the electrostatic actuator, a droplet discharge apparatus, a device including the electrostatic actuator, and a method for manufacturing the droplet discharge head.

An electrostatic actuator according to the present invention includes a diaphragm, a counter electrode disposed opposite to the diaphragm with a gap interposed therebetween, and an insulating film disposed on a surface of the diaphragm facing the counter electrode. The insulating film includes at least a dielectric film formed of a substance having a higher relative dielectric constant than silicon oxide.

The dielectric film formed of a substance having a higher relative dielectric constant than silicon oxide in the insulating film can provide sufficient insulating properties and increase the generated pressure under a given voltage, as compared with an insulating film formed only of silicon oxide.

In the electrostatic actuator according to the present invention, the dielectric film is formed of silicon oxynitride, aluminum oxide, tantalum oxide, hafnium silicon nitride, or hafnium silicon oxynitride.

The dielectric film formed of a high-k material (a substance having a high relative dielectric constant), such as silicon oxynitride, aluminum oxide, tantalum oxide, hafnium silicon nitride, or hafnium silicon oxynitride can have a higher relative dielectric constant than silicon oxide.

In the electrostatic actuator according to the present invention, the insulating film includes a silicon oxide film.

The dielectric film having a high relative dielectric constant and the silicon oxide film having a high insulation resistance in the insulating film can increase the generated pressure under a given voltage and improve the insulation resistance.

Furthermore, for example, in an inkjet head, a sufficient bonding strength can be achieved when an anodically bonded interface between a cavity substrate formed of silicon and an electrode glass substrate formed of a borosilicate glass is formed of silicon oxide. Furthermore, the interface formed of silicon oxide can prevent a leakage of electric current from the interface.

Furthermore, in the electrostatic actuator according to the present invention, the silicon oxide film has an opening, in which a dielectric film is formed.

For example, in an inkjet head, when the dielectric film is exposed from the opening in the diaphragm of the silicon oxide film opposite to a counter electrode, the relative dielectric constant will be further increased and the generated pressure will be further increased under a given voltage.

Furthermore, in the electrostatic actuator according to the present invention, the dielectric film and the silicon oxide film are laminated.

The lamination of the dielectric film and the silicon oxide film can increase the generated pressure under a given voltage and further improve the insulation resistance.

Furthermore, in the electrostatic actuator according to the present invention, the silicon oxide film is closer to the counter electrode than the dielectric film is.

For example, an insulating film having a two-layer structure can easily be formed by forming a silicon oxide film on a dielectric film by CVD.

Furthermore, in the electrostatic actuator according to the present invention, the dielectric film is closer to the counter electrode than the silicon oxide film is.

Since the dielectric film is closer to the counter electrode than the silicon oxide film is, the silicon oxide film serves as a passivation layer (chemically inert layer) or a stress relaxation layer. Thus, a variety of materials can be used as the dielectric film.

Furthermore, the electrostatic actuator according to the present invention includes an electrode substrate on which the counter electrode is formed. The electrode substrate is bonded to a cavity substrate on which the diaphragm is formed. Only a silicon oxide film is formed at a bonded portion of the cavity substrate and the electrode substrate as a insulating film.

Since only a silicon oxide film is formed at the bonded portion of the cavity substrate and the electrode substrate, when the cavity substrate is formed of silicon and the electrode substrate is formed of a borosilicate glass, the anodic bonding can be performed and a sufficient bonding strength can be achieved. Furthermore, the interface formed of silicon oxide can prevent a leakage of electric current from the interface between the cavity substrate and the electrode substrate.

Furthermore, in the electrostatic actuator according to the present invention, the diaphragm is formed of silicon or impurity-doped silicon.

For example, when a substrate on which the diaphragm is formed (the cavity substrate described above) is formed of silicon and the diaphragm is formed of boron-doped silicon, etching can easily be performed.

The electrostatic actuator according to the present invention includes a diaphragm; a counter electrode disposed opposite to the diaphragm with a gap interposed therebetween, wherein a voltage is applied between the counter electrode and the diaphragm; and an insulating film disposed on a surface of the diaphragm opposite to the counter electrode, wherein the insulating film is a laminate of a cap layer for preventing impurities in the diaphragm from diffusing into the insulating film and a dielectric film formed of a substance having a higher relative dielectric constant than silicon oxide.

According to the electrostatic actuator of the present invention, the cap layer prevents or reduces the diffusion of impurities, such as boron, into the insulating film, thus providing sufficient withstand voltage to the insulating film for a long period of time. The dielectric film reduces the equivalent oxide film thickness of the entire insulating film, thus providing sufficient withstand voltage and increasing electrostatic stress. Thus, the present invention provides an adequate withstand voltage between the diaphragm and the counter electrode and also reduces the driving voltage of the actuator, thus achieving a small electrostatic actuator with high driving durability.

The insulating film further comprises a laminated surface layer for reducing the surface charge density of the insulating film.

This can reduce the effects of the residual electric charge on the surface of the insulating film constituting the surface of the diaphragm, thus achieving the stable driving of the electrostatic actuator.

Preferably, the cap layer is formed of silicon oxide or silicon nitride. A substrate on which the diaphragm is to be formed is typically a silicon substrate. Thus, silicon oxide can easily be formed. Furthermore, silicon nitride has outstanding barrier properties for boron.

Furthermore, the surface layer may be formed by forming a silicon oxide film or a silicon nitride film or by applying a silane-based coating or a fluorine-based coating.

A droplet discharge head according to the present invention includes any of the electrostatic actuators described above, wherein a cavity substrate including the diaphragm and an electrode substrate including the counter electrode are bonded together, and the diaphragm constitutes the bottom surface of a droplet discharge chamber for containing droplets to be discharged. This provides a droplet discharge head having a high droplet discharge pressure at low voltage.

A droplet discharge apparatus according to the present invention includes the droplet discharge head described above. This provides a droplet discharge apparatus having excellent driving performance.

A device according to the present invention includes any of the electrostatic actuators described above. This provides a device having excellent driving performance.

A method for manufacturing a droplet discharge head according to the present invention includes the steps of forming a first insulating film formed of a substance having a higher relative dielectric constant than silicon oxide on a surface of a substrate on which a diaphragm is to be formed, etching the first insulating film to form a section and thereby form a dielectric film, and forming a second insulating film formed of silicon oxide at least on the dielectric film.

Since a dielectric film is formed on a surface of a substrate on which a diaphragm is to be formed and a second insulating film formed of silicon oxide is formed on the dielectric film, the pressure generated at the diaphragm in the droplet discharge head is increased under a given voltage and the droplet discharge head has a high insulation resistance. Alternatively, a portion of the second insulating film opposite to the counter electrode may be opened.

Furthermore, a method for manufacturing a droplet discharge head according to the present invention includes the steps of forming a second insulating film formed of silicon oxide on a surface of a substrate on which a diaphragm is to be formed, forming a first insulating film formed of a substance having a higher relative dielectric constant than silicon oxide at least on the second insulating film, and etching the first insulating film to form a section and thereby form a dielectric film.

Since a second insulating film formed of silicon oxide is formed on a surface of a substrate on which a diaphragm is to be formed and a dielectric film is formed on the second insulating film, the silicon oxide film serves as a passivation layer (chemically inert layer) or a stress relaxation layer. Thus, a variety of materials can be used as the dielectric film.

A method for manufacturing a droplet discharge head according to the present invention includes the steps of forming an insulating film by laminating a cap layer for preventing impurities in a diaphragm from diffusing and a dielectric film formed of a substance having a higher relative dielectric constant than silicon oxide on the surface of a cavity substrate on which the diaphragm is formed, bonding the cavity substrate including the insulating film with an electrode substrate including a counter electrode in correspondence with the diaphragm while an area in which the diaphragm is formed and the counter electrode face each other, etching the cavity substrate bonded to the electrode substrate to form a droplet discharge chamber including the diaphragm, and bonding a nozzle substrate to an opening surface of the cavity substrate.

Furthermore, a method for manufacturing a droplet discharge head according to the present invention includes the steps of forming an insulating film by laminating a cap layer for preventing impurities in a diaphragm from diffusing and a dielectric film formed of a substance having a higher relative dielectric constant than silicon oxide on the surface of a cavity substrate on which the diaphragm is formed, etching the cavity substrate including the insulating film to form a droplet discharge chamber including the diaphragm, bonding the cavity substrate including the droplet discharge chamber with an electrode substrate including a counter electrode in correspondence with the diaphragm while the diaphragm and the counter electrode face each other, and bonding a nozzle substrate to an opening surface of the cavity substrate.

These methods make it possible to manufacture a small electrostatic actuator with high durability in which an adequate withstand voltage between the diaphragm and the counter electrode is maintained for a long period of time and the driving voltage of the actuator is reduced.

Furthermore, the step of forming an insulating film includes forming a surface layer for reducing the surface charge density of the insulating film on the dielectric film.

This method can reduce the effects of the residual electric charge on the surface of the insulating film constituting the surface of the diaphragm. Thus, an electrostatic actuator that can be driven stably can be manufactured.

BEST MODE FOR CARRYING OUT THE INVENTION

Embodiment 1

Figure 1:
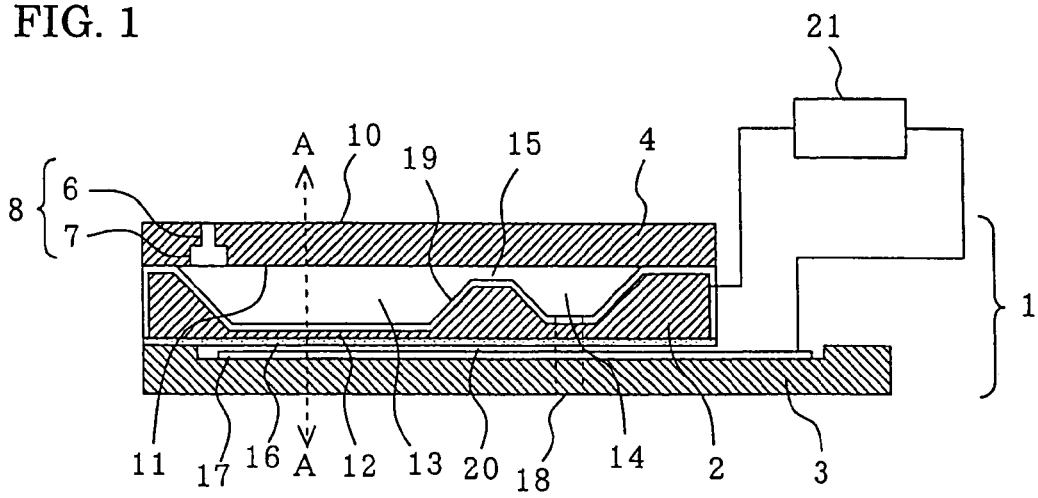
[FIG. 1] A longitudinal sectional view illustrating a droplet discharge head according to Embodiment 1 of the present invention.

FIG. 1 is a longitudinal sectional view illustrating a droplet discharge head according to Embodiment 1 of the present invention. In FIG. 1, a drive circuit 21 is schematically illustrated. Furthermore, FIG. 1 illustrates an example of a droplet discharge head including an electrostatic actuator according to the present invention. This droplet discharge head is driven electrostatically and is of face-ejection type.

The droplet discharge head 1 according to the present Embodiment 1 is a composite mainly of a cavity substrate 2, an electrode substrate 3, and a nozzle substrate 4. The nozzle substrate 4 is formed of silicon and has a nozzle 8, which includes a first nozzle opening 6, for example, of a cylindrical shape and a second nozzle opening 7, for example, of a cylindrical shape, which communicates with the first nozzle opening 6 and is larger in diameter than the first nozzle opening 6. The first nozzle 6 is formed to open a droplet discharge surface 10 (a surface opposite to a bonding surface 11 of the cavity substrate 2), and the second nozzle 7 is formed to open the bonding surface 11 of the cavity substrate 2.

The cavity substrate 2 is formed, for example, of single-crystal silicon and includes a plurality of concave portions that serve as discharge chambers 13 having a diaphragm 12 at the bottom. The plurality of discharge chambers 13 are arranged in parallel with each other in the direction perpendicular to the drawing in FIG. 1. Furthermore, the cavity substrate 2 is provided with a concave portion of reservoir 14, from which droplets, such as ink, are supplied to each discharge chamber 13, and other concave portions of narrow orifices 15 communicating with the reservoir 14 and each discharge chamber 13. In the droplet discharge head 1 shown in FIG. 1, the reservoir 14 is formed as a single concave portion, and the orifices 15 are individually formed for each discharge chamber 13. The orifices 15 may be formed in the bonding surface 11 of the nozzle substrate 4.

Furthermore, an insulating film 16 is formed on a surface of the cavity substrate 2 to which the electrode substrate 3 is bonded. This insulating film 16 prevents dielectric breakdown and short during the driving of the droplet discharge head 1. The insulating film 16 is composed of a dielectric film 16*a* and a silicon oxide film 16*b* (see FIG. 2): The insulating film 16 will be described in detail later. Furthermore, a protective film 19 against droplets is formed on a surface of the cavity substrate 2 to which the nozzle substrate 4 is bonded. This protective film 19 against droplets protects the cavity substrate 2 from being etched by droplets in the discharge chambers 13 or the reservoir 14.

The electrode substrate 3 formed, for example, of a borosilicate glass is bonded to the diaphragm 12 side of the cavity substrate 2. The electrode substrate 3 is provided with a plurality of counter electrodes (individual electrodes) 17 opposing to the diaphragm 12 with a gap 20 interposed therebetween. The counter electrodes 17 are formed, for example, by sputtering indium tin oxide (ITO). A liquid-supply hole 18, which communicates with the reservoir 14, is formed in the electrode substrate 3. This liquid-supply hole 18 is connected to a hole in the bottom wall of the reservoir 14, thereby supplying droplets, such as ink, to the reservoir 14 from the outside.

When the cavity substrate 2 is formed of single-crystal silicon and the electrode substrate 3 is formed of a borosilicate glass, the cavity substrate 2 and the electrode substrate 3 can be anodically bonded.

The operation of the droplet discharge head 1 shown in FIG. 1 will be described below. The cavity substrate 2 and each counter electrode 17 are connected to the drive circuit 21. Upon the application of a pulse voltage between the cavity substrate 2 and the counter electrodes 17 by the drive circuit 21, the diaphragm 12 bends toward the counter electrodes 17. This causes droplets, such as ink, in the reservoir 14 to flow into the discharge chambers 13. In the present Embodiment 1, when the diaphragm 12 bends toward the counter electrodes 17, the diaphragm 12 (insulating film 16) comes into contact with the counter electrodes 17. Upon the removal of the voltage between the cavity substrate 2 and the electrodes 17, the diaphragm 12 returns to the original position. This causes a pressure increase within the discharge chambers 13, thus allowing droplets, such as ink, to be discharged from the nozzle 8.

As is evident from the above, in the droplet discharge head 1, the diaphragm 12 including the insulating film 16 and the counter electrodes 17 constitute an electrostatic actuator driven by the drive circuit 21.

Figure 2:
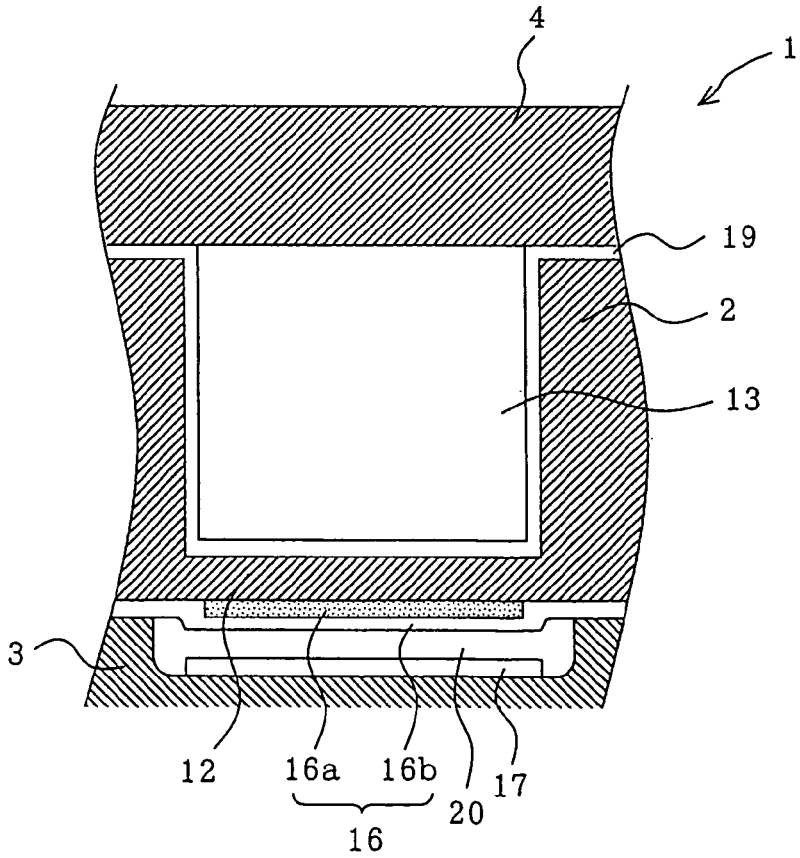
[FIG. 2] An enlarged cross-sectional view taken along line A-A of FIG. 1.

FIG. 2 is an enlarged cross-sectional view taken along line A-A of FIG. 1. While FIG. 2 illustrates only one discharge chamber 13, a plurality of discharge chambers 13 are practically formed in the direction parallel to the drawing in FIG. 2.

As shown in FIG. 2, the insulating film 16 in the droplet discharge head 1 according to the present Embodiment 1 has a two-layer structure of a dielectric film 16*a* and a silicon oxide film 16*b*. The dielectric film 16*a* is formed of a substance having a higher relative dielectric constant than silicon oxide ($SiO_2$) and is formed, for example, of silicon oxynitride (SiON), aluminum oxide ($Al_2O_3$), tantalum oxide ($Ta_2O_5$), hafnium silicon nitride (HfSiN), or hafnium silicon oxynitride (HfSiON). These substances are insulating materials generally called high-k materials and have higher relative dielectric constants than silicon oxide. Furthermore, in addition to the substance described above, a high-k material, such as silicon nitride ($Si_3N_4$), hafnium-aluminum oxide (HfAlOx), diamond, or zirconium oxide ($ZrO_2$) may be used as the constituent material of the dielectric film 16*a*. Furthermore, although its practical use may be difficult for its low insulation resistance, the use of a piezoelectric material (PZT) or a ferroelectric substance, such as a barium-titanic oxide ($BaTiO_3$) is also contemplated.

In the droplet discharge head 1 shown in FIG. 2, the dielectric film 16*a* is formed only at the portion opposite to the counter electrode 17. The silicon oxide film 16*b* is formed on the dielectric film 16*a* and over the remaining surface of the cavity substrate 2 (a surface bonded to the electrode substrate 3). Thus, the silicon oxide film 16*b* is closer to the counter electrode 17 than the dielectric film 16*a* is. Hence, only silicon oxide film 16*b* is formed at the interface between the cavity substrate 2 and the electrode substrate 3.

As shown below, while the cavity substrate 2 and the electrode substrate 3 are anodically bonded in the present Embodiment 1, silicon oxide is a substance suitable for anodic bonding. The silicon oxide film 16*b* at the interface desirably has a small thickness. In the droplet discharge head 1 according to the present Embodiment 1, since the interface between the cavity substrate 2 and the electrode substrate 3 is formed only with the silicon oxide film 16*b*, anodic bonding can achieve a sufficient bonding strength. In addition, the silicon oxide film 16*b* can prevent electric current from leaking from the counter electrode 17 to the cavity substrate 2.

Now, the insulating film 16 composed of the dielectric film 16*a* and the silicon oxide film 16*b* in FIG. 2 will be described.

The electrostatic stress (generated pressure) P attracting the diaphragm 12 in operation is expressed by the following equation:

[Mathematical Expression 1]

$$P(x) = \frac{1}{S}\frac{\partial E(x)}{\partial x} = -\frac{\varepsilon_0}{2}\frac{V^2}{\left(\frac{t}{\varepsilon_r} + x\right)^2} \quad \text{(Eq. 1)}$$

where E denotes electrostatic energy, x denotes the distance between the diaphragm 12 and the counter electrode 17 (including the distance in operation), s denotes the area of the diaphragm 12, V denotes applied voltage, t denotes the thickness of the insulating film 16, $\in_0$ denotes the vacuum dielectric constant, and $\in_r$ denotes the relative dielectric constant of the insulating film 16.

Furthermore, the average pressure $P_e$ in the operation of the diaphragm 12 is expressed by the following equation:

[Mathematical Expression 2]

$$P_e = \frac{1}{d}\int_0^d P(x)\,dx = \frac{\varepsilon_0\varepsilon_r}{2}\frac{V^2}{t\left(\frac{t}{\varepsilon_r} + d\right)} \quad \text{(Eq. 2)}$$

where d denotes the distance (height of a gap 20) between the diaphragm 12 and the counter electrode 17 when the diaphragm 12 is not driven.

When the insulating film 16 composed of two layers of the dielectric film 16*a* and the silicon oxide film 16*b* is driven, the average pressure $P_e$ is expressed by the following equation:

[Mathematical Expression 3]

$$P_e = \frac{\varepsilon_0 V^2}{2\left(\frac{t_1}{\varepsilon_1} + \frac{t_2}{\varepsilon_2}\right)\left(d + \frac{t_1}{\varepsilon_1} + \frac{t_2}{\varepsilon_2}\right)} \quad \text{(Eq. 3)}$$

where $t_1$ denotes the thickness of the dielectric film 16*a*, $t_2$ denotes the thickness of the silicon oxide film 16*b*, $\in_1$ denotes the relative dielectric constant of the dielectric film 16*a*, and $\in_2$ denotes the relative dielectric constant of the silicon oxide film 16*b*.

As shown in Equation 2, the average pressure $P_e$ increases with increase in the relative dielectric constant of the insulating film 16. Thus, the use of a high-k material having a high relative dielectric constant for the dielectric film 16*a* increases the generated pressure in the electrostatic actuator.

Furthermore, when a high-k material is applied to the droplet discharge head 1, a power required to discharge droplets can be obtained even with the diaphragm 12 having a smaller area. Thus, in the droplet discharge head 1, the resolution of nozzles 8 can be improved by reducing the width of the diaphragm 12 and thus reducing the pitch of the discharge chambers 13, that is, the pitch of the nozzles 8. This provides a droplet discharge head 1 that can perform finer printing at high speed. In addition, shortening the diaphragm 12 can improve the response of droplets in the flow pass and thereby increase the driving frequency, thus achieving higher-speed printing.

For example, when the relative dielectric constant of the insulating film 16 is doubled as a whole, almost the same pressure can be generated with the insulating film 16 having a doubled thickness. Thus, the dielectric breakdown strength, such as time-dependent dielectric breakdown (TDDB, dielectric breakdown strength for a long period of time) or time-zero dielectric breakdown (TZDB, momentary dielectric breakdown strength), of the electrostatic actuator can be almost doubled.

Figure 3:
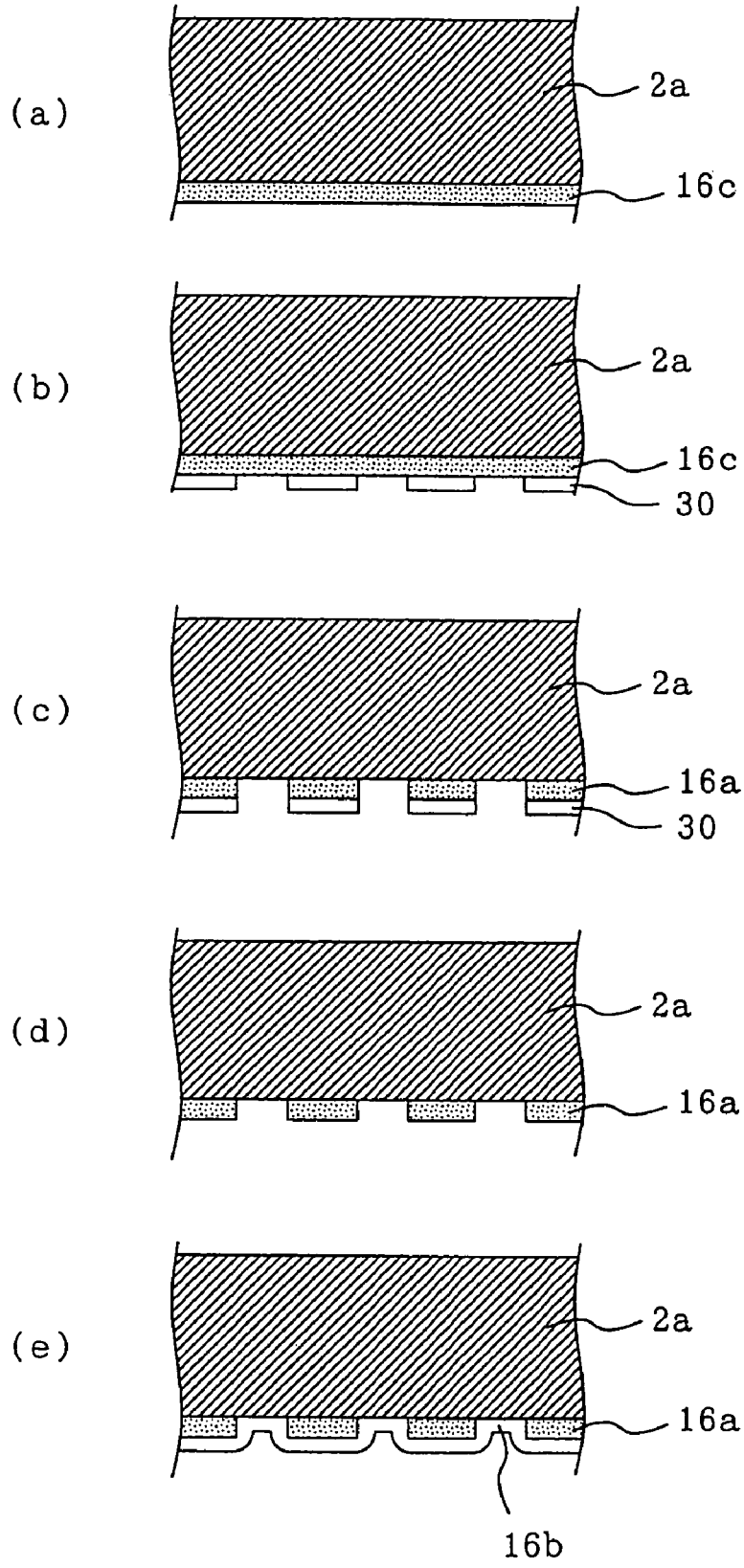
[FIG. 3] A cross-sectional view illustrating a manufacturing process of a droplet discharge head according to Embodiment 1 of the present invention.
Figure 4:
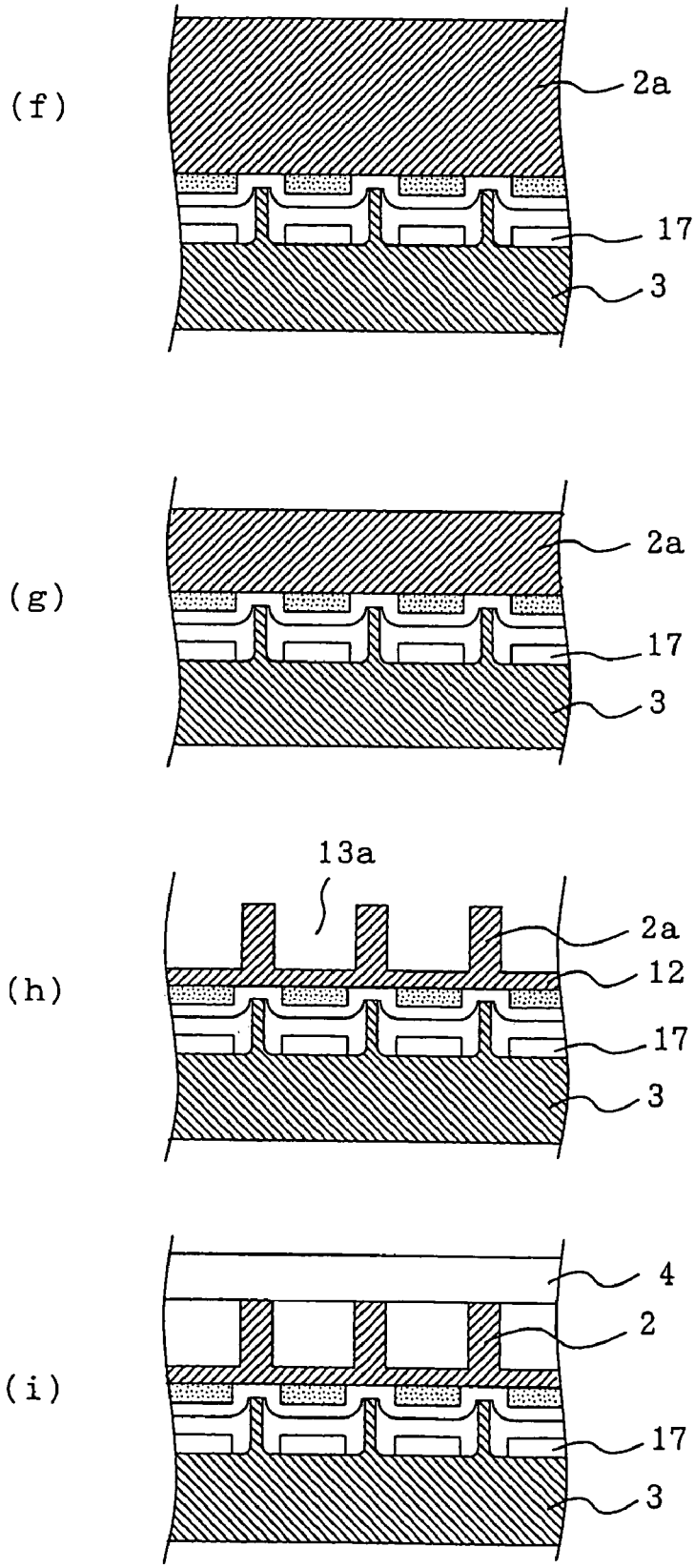
[FIG. 4] A cross-sectional view illustrating the manufacturing process, continued from FIG. 3.

FIGS. 3 and 4 are cross-sectional views illustrating a process for manufacturing the droplet discharge head according to Embodiment 1 of the present invention. FIGS. 3 and 4 illustrate a process for manufacturing the droplet discharge head 1 shown in FIGS. 1 and 2, and is a cross-sectional view taken along line A-A in the droplet discharge head 1 in FIG. 1. The method for manufacturing the cavity substrate 2 and the electrode substrate 3 is not limited to that shown in FIGS. 3 and 4.

First, both sides of a silicon substrate 2*a* having a thickness, for example, of 525 μm is mirror-polished, and then a first insulating film 16*c* formed, for example, of $Al_2O_3$ having a thickness, for example, of 50 nm is formed by electron cyclotron resonance (ECR) sputtering or plasma chemical vapor deposition (CVD) (FIG. 3(*a*)). The ECR sputtering can form an insulating film having a reduced stress at relatively low temperature. The plasma CVD can form a dense insulating film.

The substance having a higher relative dielectric constant than silicon oxide as described above may be used to form the film in place of $Al_2O_3$. A surface on which the first insulating film 16*c* is to be formed is desirably washed with an aqueous ammonia before the film is formed. Furthermore, a boron-doped layer may be formed by diffusing boron into the surface of the silicon substrate 2*a* on which the first insulating film 16*c* is to be formed before the film is formed. This boron-doped layer functions as an etch-stop layer in wet etching in a subsequent step shown in FIG. 4(*h*).

Then, resists 30 are patterned on the first insulating film 16*c* by photolithography (exposure to light, development, etc.) (FIG. 3(*b*)). In FIG. 3(*b*), the patterning is performed to leave only portions of the first insulating film 16*c* (dielectric film 16*a* in the following steps) opposite to the counter electrodes 17 (see FIG. 2).

Then, the first insulating film 16*c* is wet etched, for example, with buffered aqueous hydrofluoric acid to form sections and thereby form dielectric films 16*a* (FIG. 3(*c*)). Instead of the wet etching with buffered aqueous hydrofluoric acid, the dielectric films 16*a* may be formed by reactive ion etching (RIE) using $CHF_3$.

Then, the resists 30 are removed, for example, by oxygen plasma, followed by washing with pure water (FIG. 3(*d*)).

Then, a silicon oxide film 16*b* having a thickness of 30 nm is formed, for example, by tetraethyl orthosilicate (TEOS) plasma chemical vapor deposition (CVD) on the entire surface of the silicon substrate 2*a* on which the dielectric films 16*a* are formed (FIG. 3(*e*)).

Then, the silicon substrate 2*a* in FIG. 3(*e*) and an electrode substrate 3 including the counter electrodes 17 are heated, for example, to 360° C. The silicon substrate 2*a* is connected to an anode and the electrode substrate 3 is connected to a cathode. Anodic bonding is performed by applying a voltage of about 800 V (FIG. 4(*f*)). The electrode substrate 3 in FIG. 4(*f*) may be prepared by etching a borosilicate glass substrate with aqueous hydrofluoric acid using a gold-chromium etching mask to form concave portions, followed by forming the counter electrodes 17 formed of indium tin oxide (ITO) in the concave portions by sputtering.

After the silicon substrate 2*a* and the electrode substrate 3 are anodically bonded together, the silicon substrate 2*a* is entirely thinned to have a thickness, for example, of 140 μm, for example, by mechanical grinding (FIG. 4(*g*)). After the mechanical grinding, a work affected layer is desirably removed by light etching, for example, with aqueous potassium hydroxide. The silicon substrate 2*a* may be thinned by wet etching with aqueous potassium hydroxide, instead of the mechanical grinding.

Then, the top surface (a surface opposite to the surface bonded to the electrode substrate 3) of the silicon substrate 2*a* is entirely covered with a silicon oxide film having a thickness, for example, of 1.5 μm by TEOS plasma CVD. Then, a resist for forming concave portions for discharge chambers 13, a concave portion for a reservoir 14, and concave portions for orifices 15 is patterned on the silicon oxide film. Then, the silicon oxide film corresponding to these concave portions is etched away.

Then, concave portions 13*a* for the discharge chambers 13, the concave portion (not shown) for the reservoir 14, and the concave portions (not shown) for the orifices 15 are formed by anisotropic wet etching of the silicon substrate 2*a* with aqueous potassium hydroxide. Then, the silicon oxide film is removed. In the wet etching step shown in FIG. 4(*h*), for example, 35% by weight of aqueous potassium hydroxide may initially be used and then 3% by weight of aqueous potassium hydroxide may be used. This can reduce the surface roughness of the diaphragm 12.

After the step shown in FIG. 4(*h*), a protective film 19 formed, for example, of silicon oxide against droplets having a thickness, for example, of 0.1 μm is formed, for example, by CVD on a surface on which the concave portions 13*a* of the discharge chambers 13 in the silicon substrate 2*a* is formed. This step is not shown in FIG. 4.

Then, a nozzle substrate 4 including a nozzle 8 formed, for example, by inductively coupled plasma (ICP) discharge is bonded to an opening surface of the silicon substrate 2*a* (cavity substrate 2), for example, with an adhesive (FIG. 4(*i*)).

Finally, a composite substrate of the cavity substrate 2, the electrode substrate 3, and the nozzle substrate 4 is separated, for example, by dicing (cutting) into a droplet discharge head 1.

In the present Embodiment 1, since the insulating film 16 includes the dielectric film 16*a* formed of a substance having a higher relative dielectric constant than silicon oxide, a higher pressure can be generated under a given voltage as compared with an insulating film formed only of silicon oxide.

In addition, the dielectric film 16*a* having a high relative dielectric constant and the silicon oxide film 16*b* having a high insulation resistance in the insulating film 16 can increase the generated pressure under a given voltage and improve the insulation resistance.

Furthermore, since an anodically bonded interface between the cavity substrate 2 formed of silicon and the electrode glass substrate 3 formed of a borosilicate glass is formed only of silicon oxide, the interface can have a sufficient bonding strength. Furthermore, the interface formed of silicon oxide can prevent a leakage of electric current from the interface.

Embodiment 2

Figure 5:
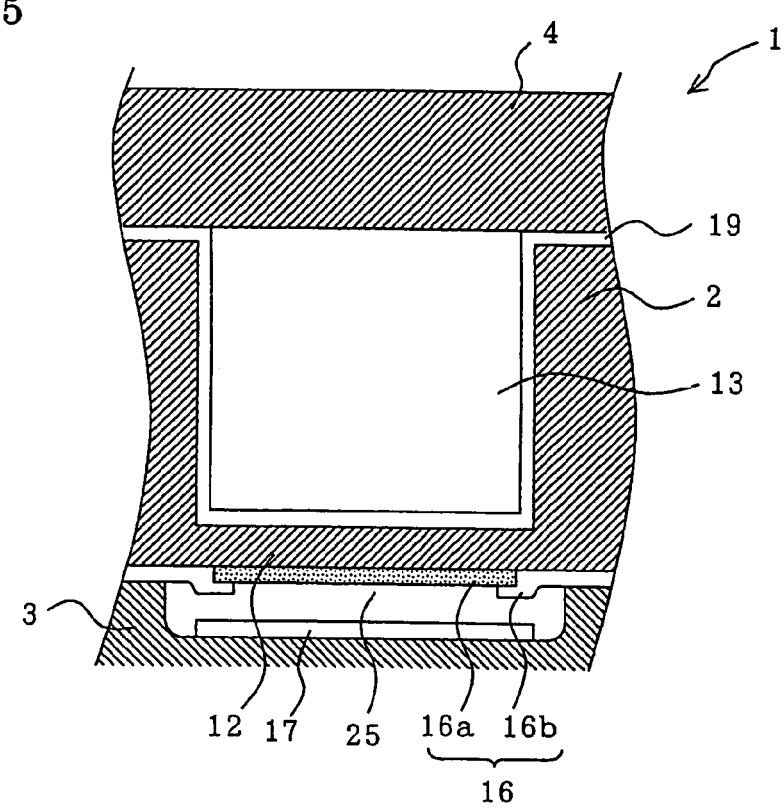
[FIG. 5] A cross-sectional view illustrating a droplet discharge head according to Embodiment 2 of the present invention.

FIG. 5 is a sectional view illustrating a droplet discharge head according to Embodiment 2 of the present invention. FIG. 5 illustrates a cross section taken along line A-A of FIG. 1, as in FIG. 2. A droplet discharge head 1 according to the present Embodiment 2 is the same as the droplet discharge head 1 in Embodiment 1, except that the silicon oxide film 16*b* has an opening 25. The same reference numerals used in Embodiments 1 and 2 refer to the same elements.

In the droplet discharge head 1 according to the present Embodiment 2, the opening 25 in the silicon oxide film 16*b* is disposed opposite to the counter electrode 17. The dielectric film 16*a* is disposed in the opening 25. Thus, the dielectric film 16*a* is exposed to the counter electrodes 17. In this portion where the dielectric film 16*a* is exposed, the pressure generated at the diaphragm 12 is greater than that in the insulating film having a two-layer structure (see Equations 2 and 3).

The droplet discharge head 1 according to the present Embodiment 2 may be manufactured by patterning a resist by photolithography after the step shown in FIG. 3(*e*) of Embodiment 1 and then removing the portion of the silicon oxide film 16*b* corresponding to the opening 25 by wet etching with potassium hydroxide.

In the present Embodiment 2, the opening 25 is formed in a portion of the silicon oxide film 16*b* where the diaphragm 12 and the counter electrode 17 face each other such that the dielectric film 16*a* is exposed. Thus, the relative dielectric constant in Embodiment 2 is larger than that of the droplet discharge head 1 in Embodiment 1. Hence, the generated pressure can be increased under a given voltage.

Furthermore, since an anodically bonded interface between the cavity substrate 2 formed of silicon and the electrode glass substrate 3 formed of a borosilicate glass is formed only of silicon oxide, the interface can have a sufficient bonding strength. Furthermore, the interface formed of silicon oxide can prevent a leakage of electric current from the interface. Other effects are the same as in the droplet discharge head 1 according to Embodiment 1.

Embodiment 3

Figure 6:
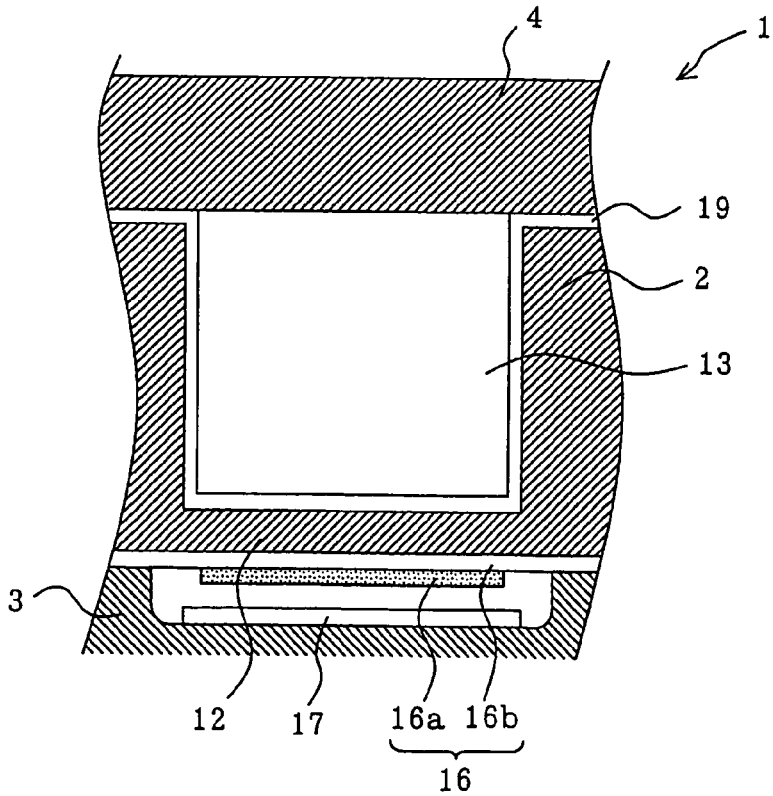
[FIG. 6] A cross-sectional view illustrating a droplet discharge head according to Embodiment 3 of the present invention.

FIG. 6 is a sectional view illustrating a droplet discharge head according to Embodiment 3 of the present invention. FIG. 6 illustrates a cross section taken along line A-A of FIG. 1, as in FIG. 2. A droplet discharge head 1 according to the present Embodiment 3 is the same as the droplet discharge head 1 in Embodiment 1, except that the dielectric film 16*a* is closer to the counter electrode 17 than the silicon oxide film 16*b* is. The same reference numerals used in Embodiments 1 and 3 refer to the same elements.

In the droplet discharge head 1 according to the present Embodiment 2, the dielectric film 16*a* is closer to the counter electrode 17 than the silicon oxide film 16*b* is and is sectioned opposite to the counter electrode 17. Furthermore, the silicon oxide film 16*b* is formed on the entire surface of the cavity substrate 2 to which the electrode substrate 3 is bonded.

The droplet discharge head 1 according to the present embodiment 3 may be manufactured by forming the silicon oxide film 16*b*, in place of the first insulating film 16*c*, over a surface of the silicon substrate 2*a* by thermal oxidation or plasma CVD in the step shown in FIG. 3(*a*) of Embodiment 1. Then, an insulating film formed of a substance having a high relative dielectric constant is formed over the entire surface of the silicon oxide film 16*b*. A resist is patterned by photolithography and is wet etched with buffered aqueous hydrofluoric acid to section the insulating film formed of a substance having a high relative dielectric constant, thus forming the dielectric film 16*a*. In this way, the silicon oxide film 16*b* and the dielectric film 16*a* as shown in FIG. 6 can be formed.

In the present embodiment 3, since the dielectric film 16*a* is closer to the counter electrode 17 than the silicon oxide film 16*b* is, the silicon oxide film 16*b* functions as a passivation layer (chemically inert layer) or a stress relaxation layer. Thus, a variety of materials can be used as the dielectric film 16*a*.

Other effects are the same as in the droplet discharge head 1 according to Embodiment 1.

Embodiment 4

Figure 7:
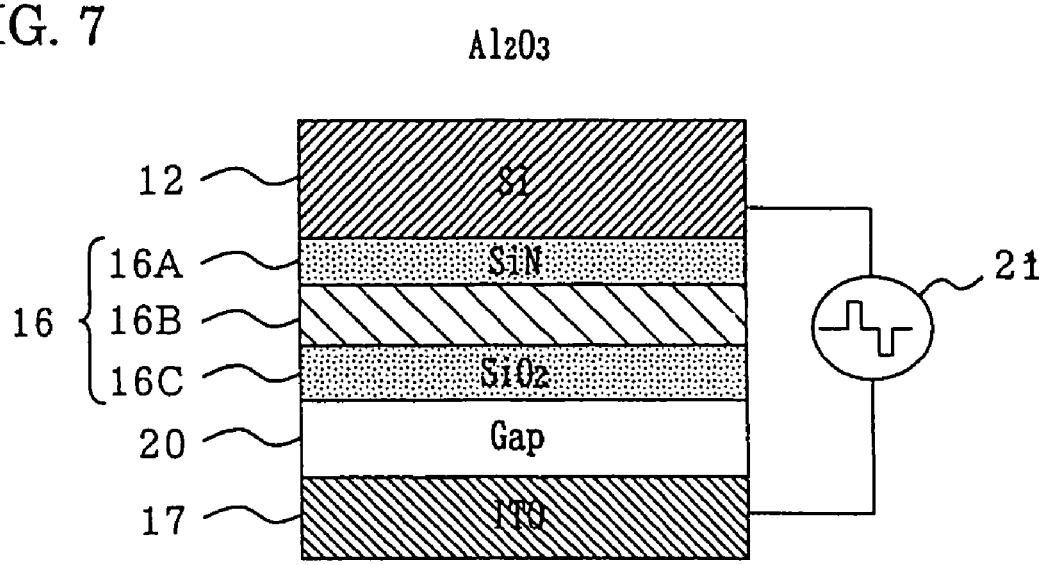
[FIG. 7] An enlarged schematic view of an electrostatic actuator portion according to Embodiment 4 of the present invention.

Then, an insulating film 16 according to another aspect will be described. FIG. 7 is an enlarged schematic view of the electrostatic actuator portion, that is, the diaphragm 12, the insulating film 16, the counter electrode 17, and the drive circuit 21 in the droplet discharge head 1 shown in FIG. 1. As show in FIG. 7, the insulating film 16 is a laminate of a cap layer 16A formed, for example, of silicon nitride (SiN), which can prevent impurities, boron in particular, from diffusing into the insulating film 16, a dielectric film 16B formed, for example, of aluminum oxide ($Al_2O_3$), which has a higher relative dielectric constant than silicon oxide, and a surface layer 16C formed, for example, of silicon oxide ($SiO_2$), which reduces the surface charge density of the insulating film 16, stacked in this order from the surface of the diaphragm 12 formed of silicon (Si). When the dielectric film 16B is formed of a material (aluminum oxide or the like) that also acts as the surface layer 16C, the surface layer 16C may be omitted. The lamination of the cap layer 16A and the dielectric film 16B provides an adequate withstand voltage between the diaphragm 12 and the counter electrode 17 for a long period of time and also reduces the driving voltage of the actuator, thus achieving a small electrostatic actuator with high driving durability. In addition, the surface layer 16C or the dielectric film 16B having the same function as the surface layer 16C reduces the effects of the residual electric charge on the surface of the insulating film 16 constituting the surface of the diaphragm 12. This provides an electrostatic actuator that can be driven stably.

Preferably, the cap layer 16A is formed of silicon oxide ($SiO_2$) or silicon nitride (SiN). Silicon nitride is superior in terms of the barrier properties for boron.

The dielectric film 16B is formed of a material having a relative dielectric constant higher than the relative dielectric constant (4.4) of silicon oxide that has conventionally been used as an insulating film. Examples of such a material include aluminum oxide ($Al_2O_3$), silicon oxynitride (SiON), tantalum oxide ($Ta_2O_5$), hafnium silicon nitride (HfSiN), and hafnium silicon oxynitride (HfSiON). These materials are insulating materials referred to as high-k materials and reduce the equivalent oxide film thickness of the entire insulating film, thus providing sufficient withstand voltage and increasing electrostatic stress. Besides these, hafnium aluminum oxide (HfAlOx) and hafnium oxide (HfOx) may be used.

Furthermore, the surface layer 16C may be formed by forming a silicon oxide film or a silicon nitride film. The density of hydroxyl groups on the surface layer 16C is reduced to prevent the surface layer 16C from attaching to the counter electrode 17. Furthermore, to inactivate the hydroxyl groups on the surface layer 16C to prevent water molecules from adsorbing to the surface layer 16C and thereby reduce the surface charge density, the surface of the gap 20 may be coated with a silane-based coating or a fluorine-based coating after the electrode substrate 3 and the cavity substrate 2 are anodically bonded together. Preferably, the coating is a monomolecular layer.

In the aluminum oxide for use in the dielectric film 16B, the metal mode is superior to the oxide mode. The aluminum oxide in the metal mode has a relative dielectric constant of 8.7 to 9.1, a withstand voltage of 5.4 to 6.3 on a bare Si substrate, and a stress of 319 MPa. The aluminum oxide in the metal mode is capable of anodic bonding. When the silicon oxynitride for use in the dielectric film 16B is in a $N_2$-rich mode, the silicon oxynitride has a relative dielectric constant of 6.2 to 6.3, a withstand voltage of 10.1 to 11 on a bare Si substrate, and a stress of 881 MPa. However, silicon oxynitride is not suitable for anodic bonding.

The insulating film 16 prevents the destruction of the actuator caused by electrical discharge when the diaphragm 12 comes into contact with the counter electrode 17 and reduces variations in the generated pressure caused by the residual electric charge.

Figure 8:
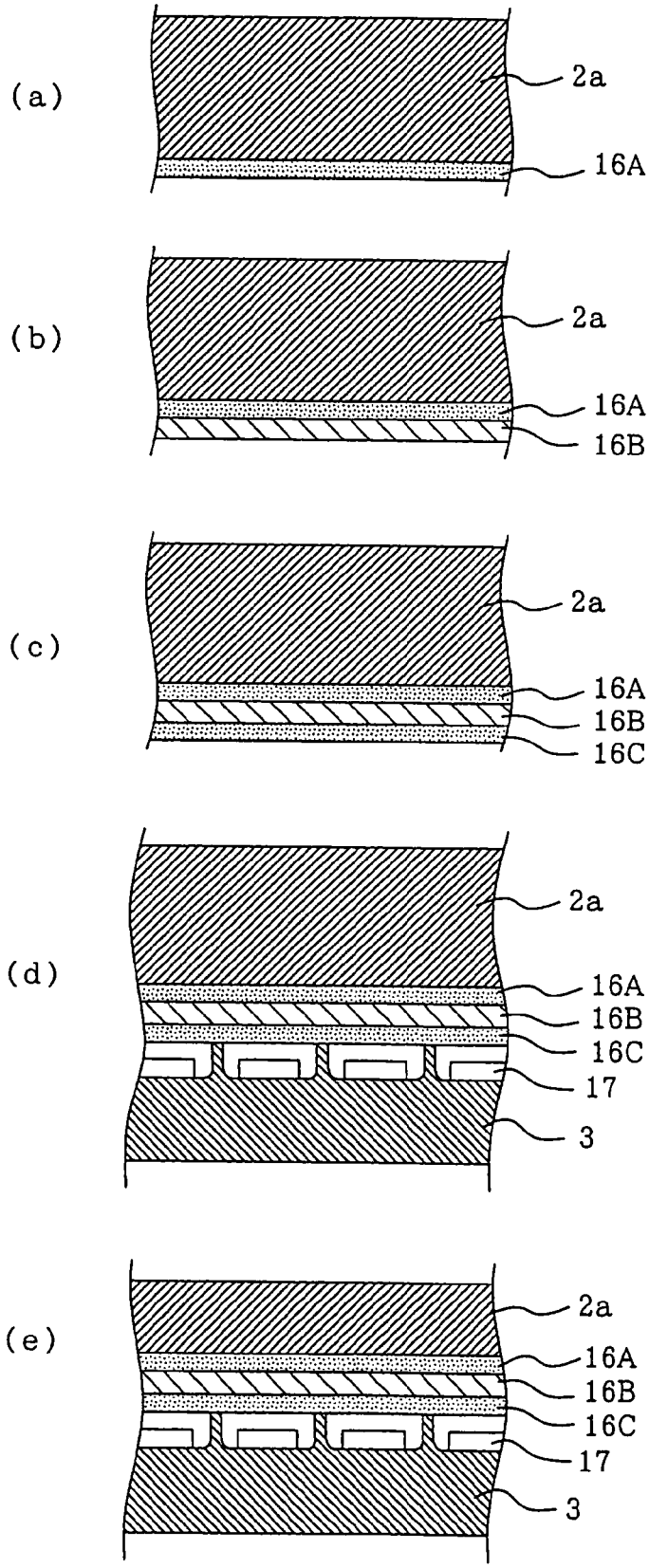
[FIG. 8] A process drawing illustrating an example of a manufacturing process of a droplet discharge head according to Embodiment 4.
Figure 9:
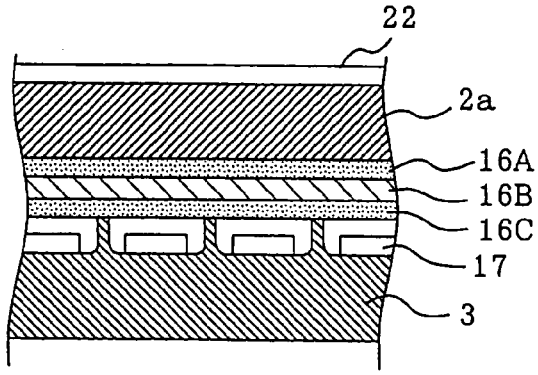
[FIG. 9] A process drawing illustrating the manufacturing process, continued from FIG. 8.
Figure 9:
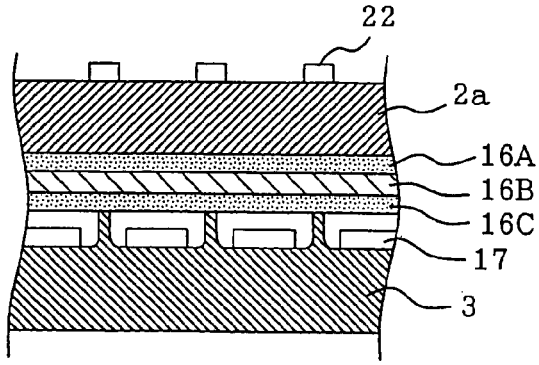
Figure 9:
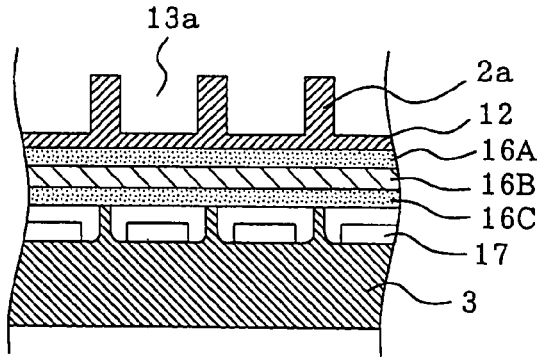
Figure 9:
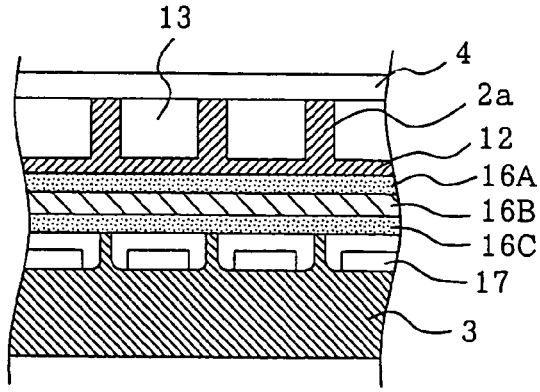

FIGS. 8 and 9 are process drawings illustrating an example of a manufacturing process of the droplet discharge head according to Embodiment 4. The method for manufacturing a cavity substrate 2 and an electrode substrate 3 is not limited to that shown in FIGS. 8 and 9.

(a) First, both sides of a silicon substrate 2*a* having a thickness, for example, of 525 μm is mirror-polished, and then a cap layer 16A is formed on the substrate 2*a*. The cap layer 16A is formed by forming a silicon oxide film, for example, by TESO plasma CVD, or by forming a silicon nitride film by plasma CVD (chemical vapor deposition) or electron cyclotron resonance (ECR) sputtering.

Before the cap layer 16A is formed, a boron-doped layer, which serves as a diaphragm 12, may be formed by diffusing boron in a surface of the silicon substrate 2*a* on which a film is to be formed. This boron-doped layer also functions as an etch-stop layer in wet etching in a subsequent step (FIG. 9(*h*)).

When the cap layer 16A is formed of a silicon oxide film, it can easily be formed with a relatively low stress. On the other hand, when the cap layer 16A is formed of a silicon nitride film, the cap layer 16A having outstanding barrier properties for boron can be formed by annealing the film at about 400° C. to 1000° C. to reduce the stress.

(b) Then, a dielectric film 16B is formed on the cap layer 16A. The dielectric film 16B is formed by ECR sputtering or plasma CVD of aluminum oxide or silicon oxynitride described above.

(c) Then, a surface layer 16C is formed on the dielectric film 16B. As described above, this step is not mandatory. In the formation of the surface layer 16C, a dense silicon oxide film formed by TESO plasma CVD is surface-treated for inactivation. This provides a surface layer 16C in which the accumulation of residual electric charges can be reduced. The surface layer 16C may also be formed by the plasma CVD or the ECR sputtering of silicon nitride. Since the silicon nitride film has a low density of hydroxyl groups on the surface, residual electric charges hardly accumulate.

As an example of a combination of thicknesses of each layer in the insulating film 16 formed as described above, the cap layer 16A, the dielectric film 16B, and the surface layer 16C may have a thickness of about 10 nm, about 80 nm, and about 10 nm, respectively. However, these thicknesses should be determined as appropriate in consideration of withstand voltage and electrostatic stress required for the insulating film 16.

(d) A cavity substrate 2 including the insulating film 16 thus formed is bonded to an electrode substrate 3 including counter electrodes 17 in correspondence with a diaphragm 12 formed on the cavity substrate 2. In this embodiment, the silicon substrate 2*a* is connected to an anode and the electrode substrate 3 is connected to a cathode while the electrode substrate 3 is heated, for example, to 360° C. Anodic bonding is performed by applying a voltage of about 800 V.

The electrode substrate 3 may be formed by etching a borosilicate glass substrate with aqueous hydrofluoric acid using a gold-chromium etching mask to form concave portions, followed by forming ITO counter electrodes 17 in the concave portions by sputtering.

(e) Then, the silicon substrate 2*a* bonded to the electrode substrate 3 is entirely thinned to have a thickness of about 140 μm, for example, by mechanical grinding. After the mechanical grinding, a work affected layer is desirably removed by light etching, for example, with aqueous potassium hydroxide. The silicon substrate 2*a* may be thinned by wet etching with aqueous potassium hydroxide, instead of the mechanical grinding.

(f) Then, the top surface (a surface opposite to the surface bonded to the electrode substrate 3) of the silicon substrate 2*a* is entirely covered with a silicon oxide film 22 having a thickness, for example, of 1.5 μm by TEOS plasma CVD.

(g) Then, a resist for forming concave portions for discharge chambers 13, a concave portion for a reservoir 14, and concave portions for orifices 15 is patterned on the silicon oxide film 22. Then, the silicon oxide film corresponding to these concave portions is etched away.

(h) Then, concave portions 13*a* for the discharge chambers 13, the concave portion (not shown) for the reservoir 14, and the concave portions (not shown) for the orifices 15 are formed by anisotropic wet etching of the silicon substrate 2*a* with aqueous potassium hydroxide. Then, the silicon oxide film is removed. This wet etching step is preferably performed by two-step etching; for example, 35% by weight of aqueous potassium hydroxide is initially used and then 3% by weight of aqueous potassium hydroxide is used. The two-step etching can reduce the surface roughness of the diaphragm 12.

Then, a protective film 19 formed, for example, of silicon oxide against droplets having a thickness, for example, of 0.1 μm is formed, for example, by CVD on a surface on which the concave portions 13*a* of the discharge chambers 13 in the silicon substrate 2*a* is formed. This step is not shown in FIG. 9.

(i) Then, a nozzle substrate 4 including a nozzle 8 formed, for example, by inductively coupled plasma (ICP) discharge is bonded to an opening surface of the silicon substrate 2*a* (cavity substrate 2), for example, with an adhesive.

Finally, a composite substrate of the cavity substrate 2, the electrode substrate 3, and the nozzle substrate 4 is separated, for example, by dicing (cutting) into a droplet discharge head 1.

In the method described above, a step of forming the insulating film in which the insulating film 16 is formed on a surface of the silicon substrate 2*a* on which the diaphragm 12 is to be formed; a step of bonding substrates in which the silicon substrate 2*a* on which the insulating film 16 is formed is bonded to the electrode substrate 3 on which the counter electrodes 17 in correspondence with the diaphragm 12 are formed while an area in which the diaphragm 12 is formed and the counter electrodes 17 face each other; a step of forming the cavity substrate 2 in which the silicon substrate 2*a* bonded to the electrode substrate 3 is etched to form the discharge chambers 13 and the reservoir 14 including the diaphragm 12; and a step of bonding the opening surface of the cavity substrate 2 to the nozzle substrate 4 are sequentially performed. In this method, since the silicon substrate 2*a* bonded to the electrode substrate 3 is etched to form the discharge chambers 13 and the reservoir 14 including the diaphragm 12, the fragile silicon substrate 2*a* can advantageously be handled with relative ease.

Furthermore, a step of forming the insulating film in which the insulating film 16 is formed on a surface of the silicon substrate 2*a* on which the diaphragm 12 is to be formed; a step of forming the cavity substrate 2 in which the silicon substrate 2*a* on which the insulating film 16 is formed is etched to form the discharge chambers 13 and the reservoir 14 including the diaphragm 12; and a step of bonding substrates in which the cavity substrate 2 on which the discharge chambers 13 is formed is bonded to the electrode substrate 3 on which the counter electrodes 17 in correspondence with the diaphragm 12 are formed while the diaphragm 12 and the counter electrodes 17 face each other; and a step of bonding an open surface of the cavity substrate 2 to the nozzle substrate 4 may be sequentially performed to manufacture the droplet discharge head 1.

These methods make it possible to manufacture a small electrostatic actuator with high driving durability in which an adequate withstand voltage between the diaphragm 12 and the counter electrodes 17 is maintained for a long period of time and the driving voltage of the actuator is reduced. Furthermore, the effects of the residual electric charge on the surface of the insulating film 16 constituting the surface of the diaphragm 12 can be reduced. Thus, an electrostatic actuator that can be driven stably can be manufactured.

Embodiment 5

Figure 10:
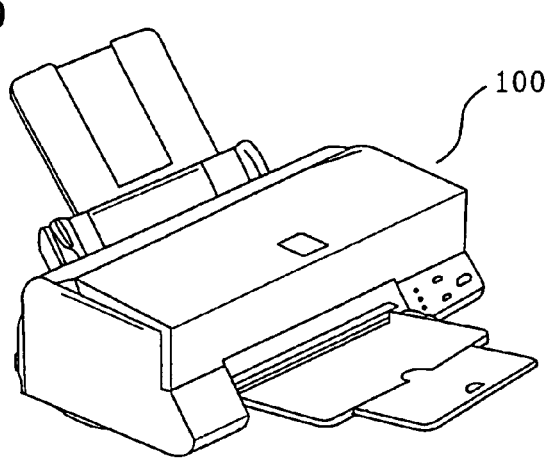
[FIG. 10] A perspective view illustrating an example of a droplet discharge apparatus according to Embodiment 5 of the present invention including a droplet discharge head according to the present invention.

FIG. 10 is a perspective view illustrating an example of a droplet discharge apparatus in which a droplet discharge head according to the embodiments described above is applied to a droplet discharge portion. A droplet discharge apparatus 100 shown in FIG. 10 is an ink-jet printer discharging ink droplets.

This ink-jet printer generates high pressure at the diaphragm 12 by the action of the droplet discharge head 1 applied thereto. Thus, the droplet discharge apparatus 100 has no missing dot and has excellent discharging performance. In addition, the droplet discharge apparatus 100 exhibits excellent durability and excellent discharge stability. In addition, the droplet discharge apparatus 100 is small and has high driving durability. Furthermore, the effects of the residual electric charge in the electrostatic actuator is reduced. This stabilizes the driving and thus permits printing with high precision.

In addition to the ink-jet printer shown in FIG. 10, the droplet discharge head 1 according to the embodiments can also be applied, by changing droplet to be discharged, to the manufacture of a color filter in a liquid crystal display, the formation of a luminous component in an organic EL display, and the discharge of biological fluid.

While the droplet discharge head in each embodiment is described as an application of the electrostatic actuator according to the present invention, the electrostatic actuator according to the embodiments of the present invention can be applied to other devices. To be more specific, the electrostatic actuator can be applied to micro electro mechanical systems (MEMS) devices, such as a tunable filter, a mirror device, and a micropump. These are applicable to a projector or a scanner for a laser printer.

Embodiment 6

As described above, the electrostatic actuator according to the present invention can be applied not only to a droplet discharge head, but also to various devices. The following is an example of the device.

Figure 11:
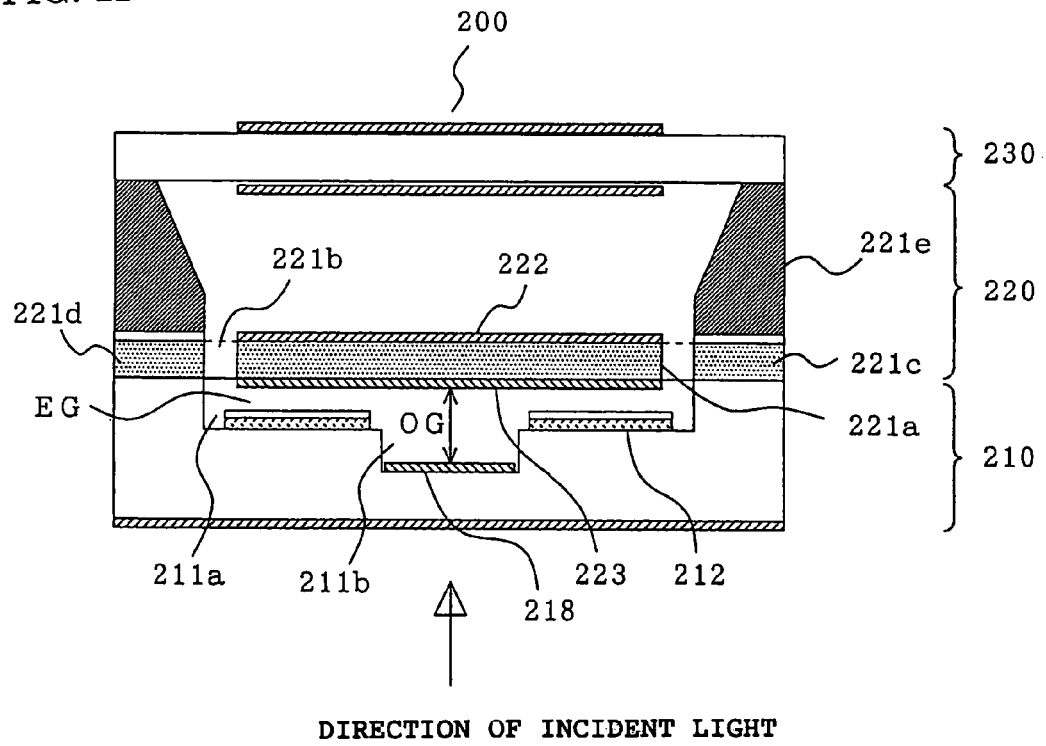
[FIG. 11] A perspective view illustrating an example of a device according to Embodiment 6 of the present invention including an electrostatic actuator according to the present invention.

FIG. 11 is a perspective view illustrating an example of a device according to Embodiment 6 of the present invention including an electrostatic actuator according to the present invention. The device including the electrostatic actuator shown in FIG. 11 is a tunable filter 200. This tunable filter 200 comprises a movable portion 221 including a movable reflective surface 223 and a single-piece construction of a movable body 221*a*, coupling portions 221*b*, supporting portions 221*c* and 221*d*, and spacers 221*e*, the movable body 221*a* moving in the direction perpendicular to the movable reflective surface 223 to allow light having a predetermined wavelength to pass through and reflect light not having the predetermined wavelength, the coupling portions 221*b* and the supporting portions 221*c* and 221*d* movably supporting the movable body 221*a*; a drive electrode portion 212 including drive electrodes 210 and a fixed reflective surface 220, the drive electrodes 212 having an electrostatic gap EG from the movable body 221*a* and moving the movable body 221*a*, the fixed reflective surface 218 having an optical gap OG from the movable reflective surface 223 and reflecting light reflected by the movable reflective surface 223, the drive electrode portion 210 being bonded with the movable portion 221 on the side opposite to the side on which the spacers 221*e* are formed while the movable reflective surface 223 and the fixed reflective surface 218 face each other; and a package portion 230 bonded to the spacers 221*e* in the movable portion 221. The movable body 221*a* and the drive electrode 212 in this Embodiment correspond to the diaphragm 12 and the counter electrodes 17 in FIG. 1, respectively, and constitute an electrostatic actuator. Thus, the formation of an insulating film corresponding to the insulating film 16 in each embodiment on the surface of the movable body 221*a* facing the drive electrode 212 will improve the withstand voltage and the electrostatic stress of the electrostatic actuator. This achieves a small tunable filter 200 with high driving durability. In addition, the effects of the residual electric charge in the electrostatic actuator can be reduced. This stabilizes the driving and thus provides light filtering with high precision.

As described above, the electrostatic actuator according to the present invention can be utilized as an actuator in various devices, particularly in micromachines. Examples of the devices to which the electrostatic actuator according to the present invention can be applied include a pump component in a micropump, a switch driving component in an optical switch, a mirror driver in a mirror device that has many subminiature mirrors and controls the direction of light by tilting the subminiature mirrors, and a driver of a laser beam steering mirror in a laser printer.

An electrostatic actuator, a droplet discharge head and a method for manufacturing the droplet discharge head, a droplet discharge apparatus, and a device according to the present invention are not limited to the embodiments of the present invention and may be modified within the spirit of the present invention. For example, the insulating film 16 may be composed only of the dielectric film 16*a*.

The invention claimed is:

1. An electrostatic actuator comprising:

a cavity substrate having a diaphragm formed thereon;

a glass electrode substrate on which a counter electrode is formed opposite to the diaphragm with a gap interposed therebetween, the glass electrode substrate being bonded to the cavity substrate; and an insulating film disposed on a surface of the cavity substrate facing the counter electrode, the diaphragm bending toward the counter electrode when voltage is applied, wherein, on the diaphragm, a dielectric film layer and a surface layer covering the dielectric film layer for reducing residual electric charges are laminated as the insulating film, the dielectric film layer being formed of silicon oxynitride, aluminum oxide, tantalum oxide, hafnium silicon nitride, or hafnium silicon oxynitride, the surface layer being formed of silicon oxide or silicon nitride, and at a bonded portion of the cavity substrate and the glass electrode substrate, a silicon oxide film without a dielectric film layer is formed as the insulating film, and the cavity substrate and the glass electrode substrate are anodically bonded with the silicon oxide film interposed therebetween.

2. The electrostatic actuator according to claim 1, wherein, when the surface layer is a silicon oxide film, the silicon oxide film at the bonded portion and the silicon oxide film of the surface layer are formed integrally.

3. The electrostatic actuator according to claim 1, wherein the diaphragm is formed of silicon or impurity-doped silicon.

4. The electrostatic actuator according to claim 1, wherein a cap layer formed of silicon oxide or silicon nitride is interposed between the diaphragm and the dielectric film.

5. The electrostatic actuator according to claim 1, wherein the surface layer is treated with a silane coating or a fluorine coating.

6. A droplet discharge head comprising the electrostatic actuator according to claim 1 in a droplet discharge portion thereof.

7. The electrostatic actuator according to claim 2, wherein the diaphragm is formed of silicon or impurity-doped silicon.

8. The electrostatic actuator according to claim 2, wherein a cap layer formed of silicon oxide or silicon nitride is interposed between the diaphragm and the dielectric film.

9. The electrostatic actuator according to claim 2, wherein the surface layer is treated with a silane coating or a fluorine coating.

10. A droplet discharge head comprising the electrostatic actuator according to claim 2 in a droplet discharge portion thereof.

11. The electrostatic actuator according to claim 3, wherein a cap layer formed of silicon oxide or silicon nitride is interposed between the diaphragm and the dielectric film.

12. The electrostatic actuator according to claim 3, wherein the surface layer is treated with a silane coating or a fluorine coating.

13. A droplet discharge head comprising the electrostatic actuator according to claim 3 in a droplet discharge portion thereof.

14. The electrostatic actuator according to claim 4, wherein the surface layer is treated with a silane coating or a fluorine coating.

15. A droplet discharge head comprising the electrostatic actuator according to claim 4 in a droplet discharge portion thereof.

16. A droplet discharge head comprising the electrostatic actuator according to claim 5 in a droplet discharge portion thereof.

17. A droplet discharge apparatus comprising the droplet discharge head according to claim 6.

* * * * *